United States Patent [19]

Onishi

[11] 4,285,541

[45] Aug. 25, 1981

[54] COMBINED CHAIR AND BED

[76] Inventor: Tetsuo Onishi, 37, Bizen, Iwade-cho, Naga-gun, Wakayama-ken, Japan

[21] Appl. No.: 63,989

[22] Filed: Aug. 6, 1979

[30] Foreign Application Priority Data

Aug. 12, 1978 [JP] Japan ..... 53/97794

[51] Int. Cl.[3] ..... A47C 17/16; A47C 13/00; A47C 1/02

[52] U.S. Cl. ..... 297/84; 5/37 R; 5/81 R; 5/86; 297/DIG. 4; 297/64

[58] Field of Search ..... 297/90, 91, 84, 68, 297/65, 64, DIG. 4, 346; 5/83, 37 R, 28, 31, 47, 81, 86

[56] References Cited

U.S. PATENT DOCUMENTS

| | | | |
|---|---|---|---|
| 2,629,425 | 2/1953 | James | 297/64 X |
| 4,079,990 | 3/1978 | McMunn | 297/DIG. 4 |
| 4,099,277 | 7/1978 | Watkins | 297/DIG. 4 |
| 4,104,747 | 8/1978 | Bell et al. | 5/37 R |
| 4,119,342 | 10/1978 | Jones | 5/81 R |

FOREIGN PATENT DOCUMENTS

| | | | |
|---|---|---|---|
| 775858 | 10/1934 | France | 297/63 |
| 636023 | 3/1962 | Italy | 5/39 |

*Primary Examiner*—James T. McCall
*Attorney, Agent, or Firm*—Omri M. Behr

[57] ABSTRACT

A combined chair and bed which can be utilized selectively as a chair and a bed comprises a frame assembly, a seat assembly including a back rest, a leg support and a seat hinged at one side edge to the back rest and at the opposite side edge to the leg support, and at least one link mechanism operable to set the combined chair and bed in selective one of chair and bed modes. While the seat assembly is mounted on the frame assembly through the link mechanism, the link mechanism comprises a fulcrum about which the back rest pivots accompanied by an angular movement of the hinge between the back rest and the seat about the same fulcrum, thereby shifting the seat selectively upwardly and downwardly depending upon the direction of the pivotal movement of the back rest and a pair of links which, when the back rest is moved to the laid-down position, are erected to support the seat in flush with any one of the back rest and the leg support. A transmission system for transmitting the movement of the back rest to the leg support is also included.

7 Claims, 6 Drawing Figures

COMBINED CHAIR AND BED

BACKGROUND OF THE INVENTION

The present invention relates to a combined chair and bed and, more particularly, to a wheel chair which can be used as or converted into a mobile bed, and vice versa.

There has been known a device which can be used selectively as either a wheel chair or a mobile bed for a patient having a difficulty in walking. The conventional device of this kind, the conventional combined wheel chair and mobile bed, is currently available in two general models. Of these models, one comprises a back rest, a leg support and a seat hinged at one side edge to the back rest and at the opposite side edge to the leg support, said back rest and said leg support being so operatively associated with the seat that, when the back rest is tilted backward, the leg support is pivoted upwards. In this model, when the back rest is completely tilted backwards until it is held in level with the seat, the leg support is also brought to a position level with any one of the seat and the back rest. The reverse movement of the back rest results in conversion of the chair into the bed.

The other model is similar in construction to the first mentioned model, but has a fulcrum about which the seat is temporarily lifted to allow the back rest and the leg support to be substantially held in flush with each other and also with the temporarily lifted seat prior to all of the back rest, the seat and the leg support being subsequently brought to the original position of the seat, that is, the position in level with the level of the seat which has been or will be assumed by the seat when the device is used as a chair.

However, when the combined chair and bed of the first mentioned model is used as a mobile bed for the purpose of transporting a patient from one stationary bed to another in a manner similar to that performed by, or in substitution for, a stretcher, the shift of the patient from the stationary bed to the mobile bed and from the mobile bed to the stationary bed can hardly be carried out with no difficulty because of the difference in height between the seat and the stationary bed.

In order to avoid the above described disadvantage or inconvenience, the design may be employed wherein the seat, when the combined chair and bed is used as a chair, is set at a height equal to the height of the stationary bed which is generally standardized. In the combined chair and bed of this alternative design, since the center of gravity is located at a relatively high position above the floor, it appears to be dangerous and, specifically, the patient steering the wheel chair tends to lose the balance particularly during the turn along a curve.

When it comes to the combined chair and bed of the second mentioned model, the switchover between the chair mode and the bed mode must be carried out while the patient leaves temporarily from the combined chair and bed. More specifically, when the chair mode is desired to be switched over to the bed mode while the patient is sitting on the chair, the weight of the patient exerts a restoration force acting on the seat being upwardly lifted to return the seat to the original position and, therefore, a relatively large pulling force is required to tilt the back rest to a position level with the seat together with the leg support. In addition, when the bed mode is desired to be switched over to the chair mode while the patient is lying on the mobile bed, the back rest, the seat and the leg support are rapidly folded to assume the chair mode by the action of the weight of the patient unless the attendant carefully controls in angularly moving the back rest, once backwardly tilted, to the initial position. The sudden and rapid folding of the assembly to the chair mode will, in many cases, give an adverse effect on the physical and psychological condition of the patient.

SUMMARY OF THE INVENTION

Accordingly, the present invention has been developed in view to substantially eliminating the above described disadvantages and inconveniences inherent in the prior art combined chair and bed and has for its essential object to provide an improved combined chair and bed which will give no substantial shock to the patient during the switchover between the chair mode and the bed mode.

Another important object of the present invention is to provide an improved combined chair and bed which does not substantially require a relatively large force in carrying out the switchover between the chair mode and the bed mode.

A further object of the present invention is to provide an improved combined chair and bed which, when used as a chair, that is, during the chair mode, the seat is held in an appropriately low position and, when used as a bed, that is, during the bed mode, the seat is held in flush with any one of the back rest and the leg support on one hand and in a high position which may be level with the height of the stationary bed.

According to the present invention, the combined chair and bed comprises a frame assembly; a seat assembly including a back rest supported in position for pivotal movement between a generally upright position and a laid-down position, and a seat hingedly connected at one side edge to the back rest so that, when the back rest is in the upright position, the back rest and the seat form a certain angle relative to each other to assume a generally L-shaped configuration; and at least one link mechanism through which the seat assembly is mounted on the frame assembly and operable to selectively bringing the combined chair and bed into one of chair and bed modes.

The link mechanism includes means fixed relative to the frame assembly for providing a fulcrum about which the back rest pivots accompanied by the pivotal movement of the back rest relative to the seat with the hinge axis between the back rest and the seat moving angularly about the fulcrum during the pivotal movement of the back rest about the fulcrum so that the seat can be shifted selectively upwardly and downwardly depending upon the direction of pivotal movement of the back rest between the upright and laid-down positions. This link mechanism further includes link means pivotally supported for movement between a generally inclined and upright positions and operable in such a manner that, when the seat is upwardly shifted incident to the pivotal movement of the back rest from the upright position towards the laid-down position, the link means are erected to assume the upright position to support the seat in flush with the back rest in the laid-down position.

The frame assembly may include a wheel assembly for enabling the frame assembly with the seat assembly to be movable from place to place.

Moreover, the seat assembly may further include a leg support hinged to the opposite side edge of the seat for the support of the legs of a patient sitting on the combined chair and bed when the latter is set in the chair mode.

According to one preferred embodiment of the present invention, the position of the fulcrum and the height of each of links forming the link means are so selected that, when the back rest is held in the laid-down position, the seat, the back rest and the leg support are all held in flush with each other to provide a bed of a height generally equal to a standard stationary bed installed in a hospital. By so doing, the various difficulties encountered heretofore with the conventional wheel chair or mobile bed can advantageously be eliminated and, in addition, the use of the separate wheel chair and mobile bed can substantially eliminated.

Moreover, when the patient sitting on the chair desires to take a sleep, he need not move from the chair to the bed. With the combined chair and bed according to the present invention, only by tilting the back rest from the upright position towards the laid-down position, the patient can enjoy sleeping in situ.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE INVENTION

Figure 1:
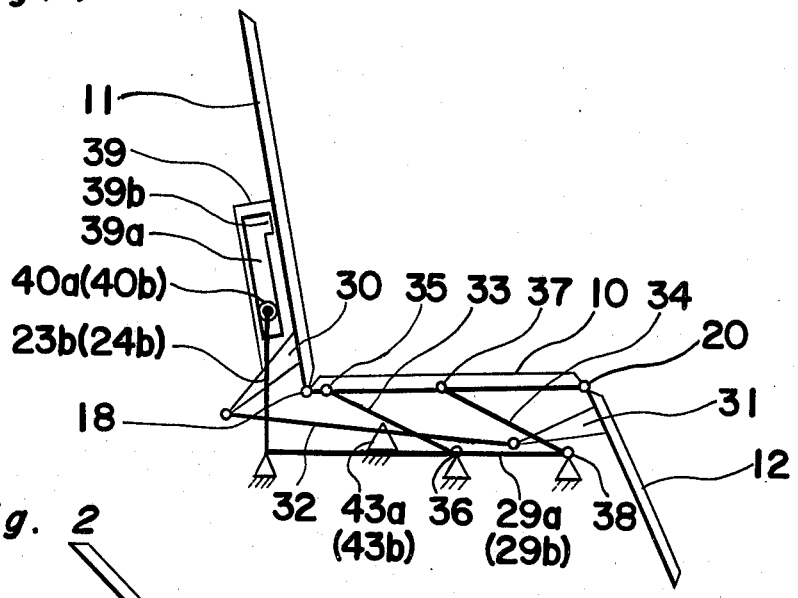
FIGS. 1 to 3 are schematic side views of a combined chair and bed according to the present invention, showing a link mechanism of the combined chair and bed in different operative positions.

Before the description of the present invention proceeds, it is to be noted that like parts are designated by like reference numerals throughout the accompanying drawings. It is also to be noted that, in view of the convertibility of the device of the present invention from a chair to a bed, and vice versa, the present invention will be described in details on the assumption that the primary function of the device of the present invention is a chair and the secondary function a bed and, accordingly, designations of components generally used in association with a chair are employed.

Figure 4:
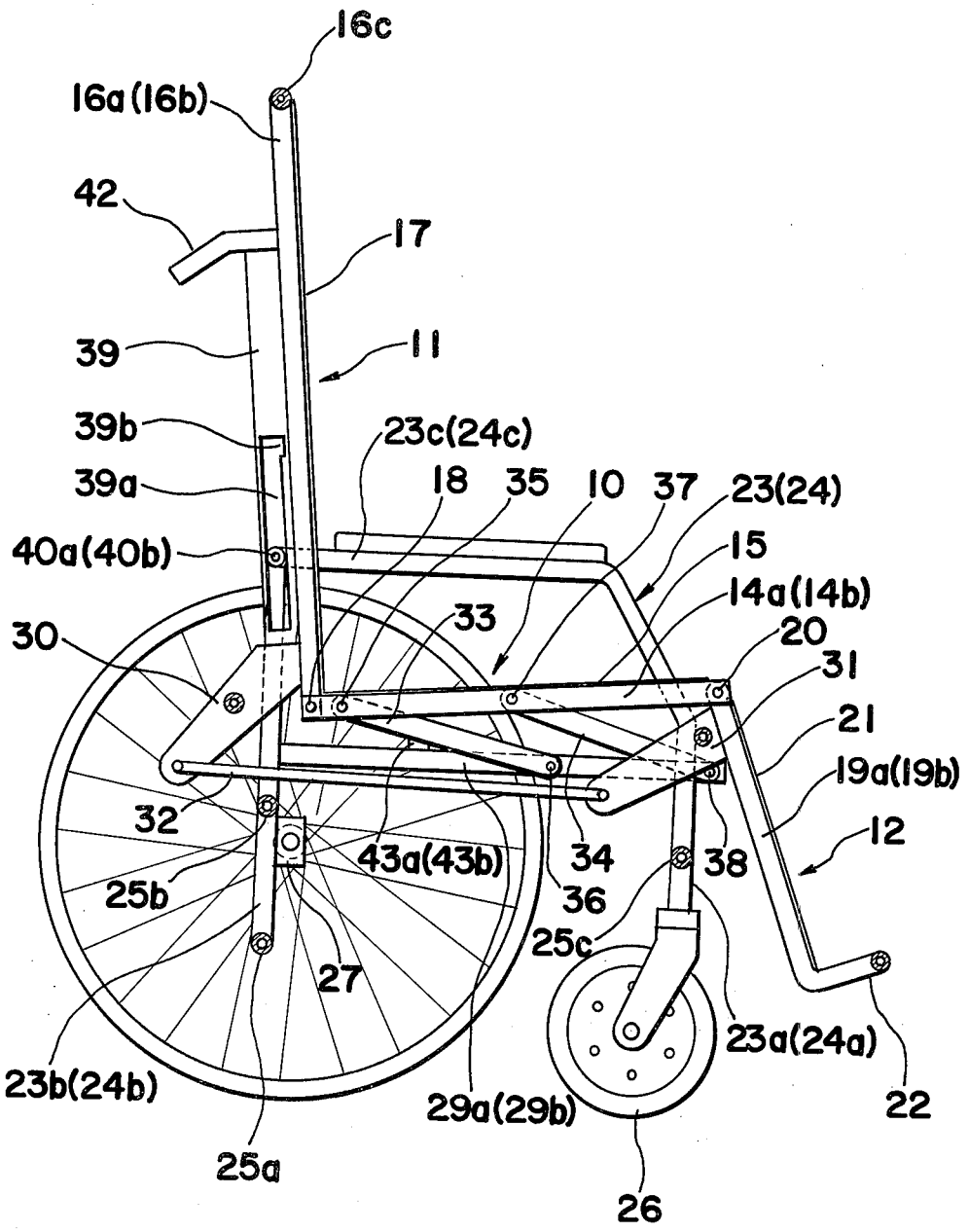
FIG. 4 is a cross sectional view of the combined chair and bed according to the present invention set in a chair mode, said cross sectional view being taken along the line IV—IV in FIG. 6.
Figure 5:
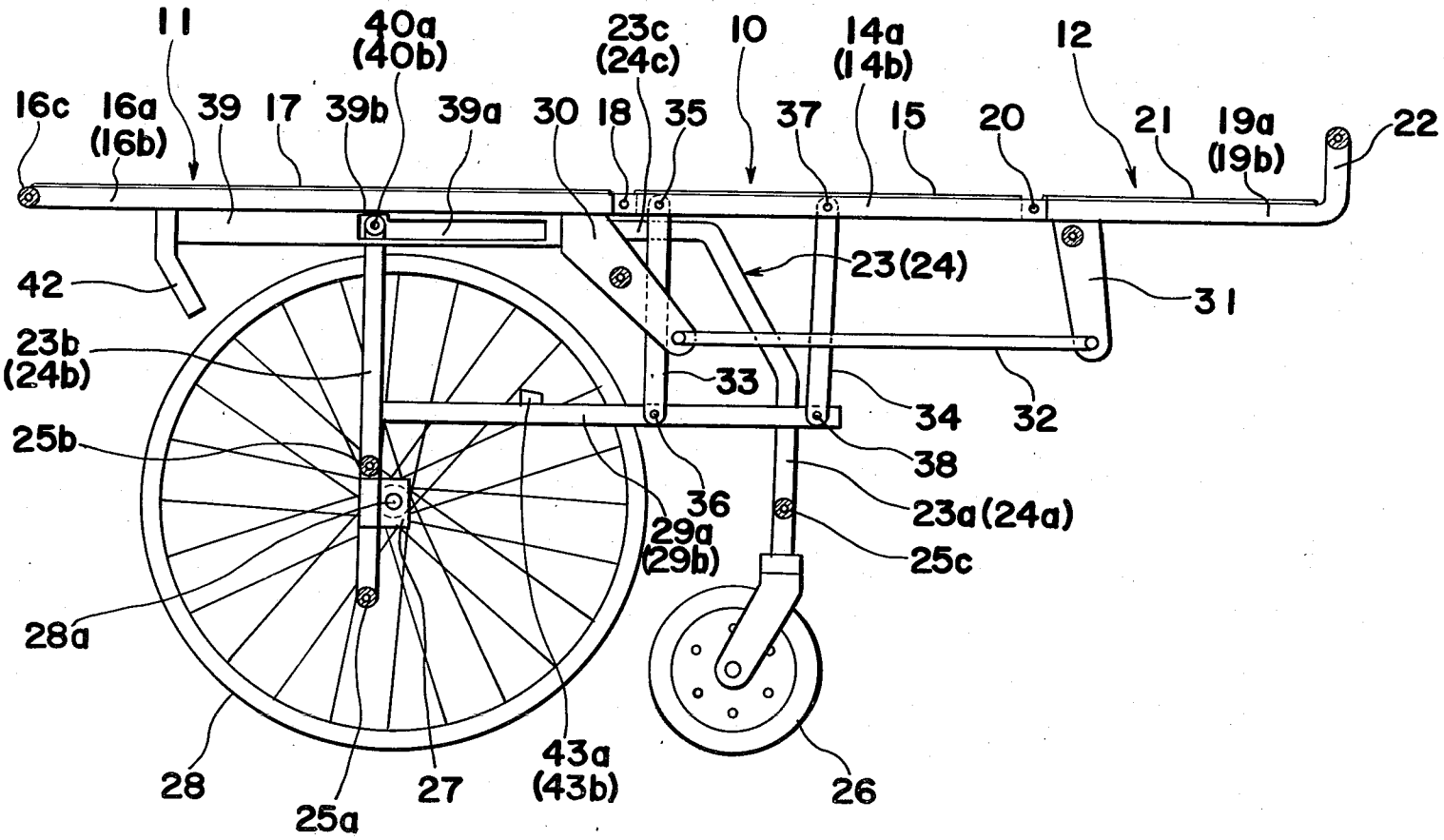
FIG. 5 is a view similar to FIG. 4, showing the combined chair and bed set in a bed mode.
Figure 6:
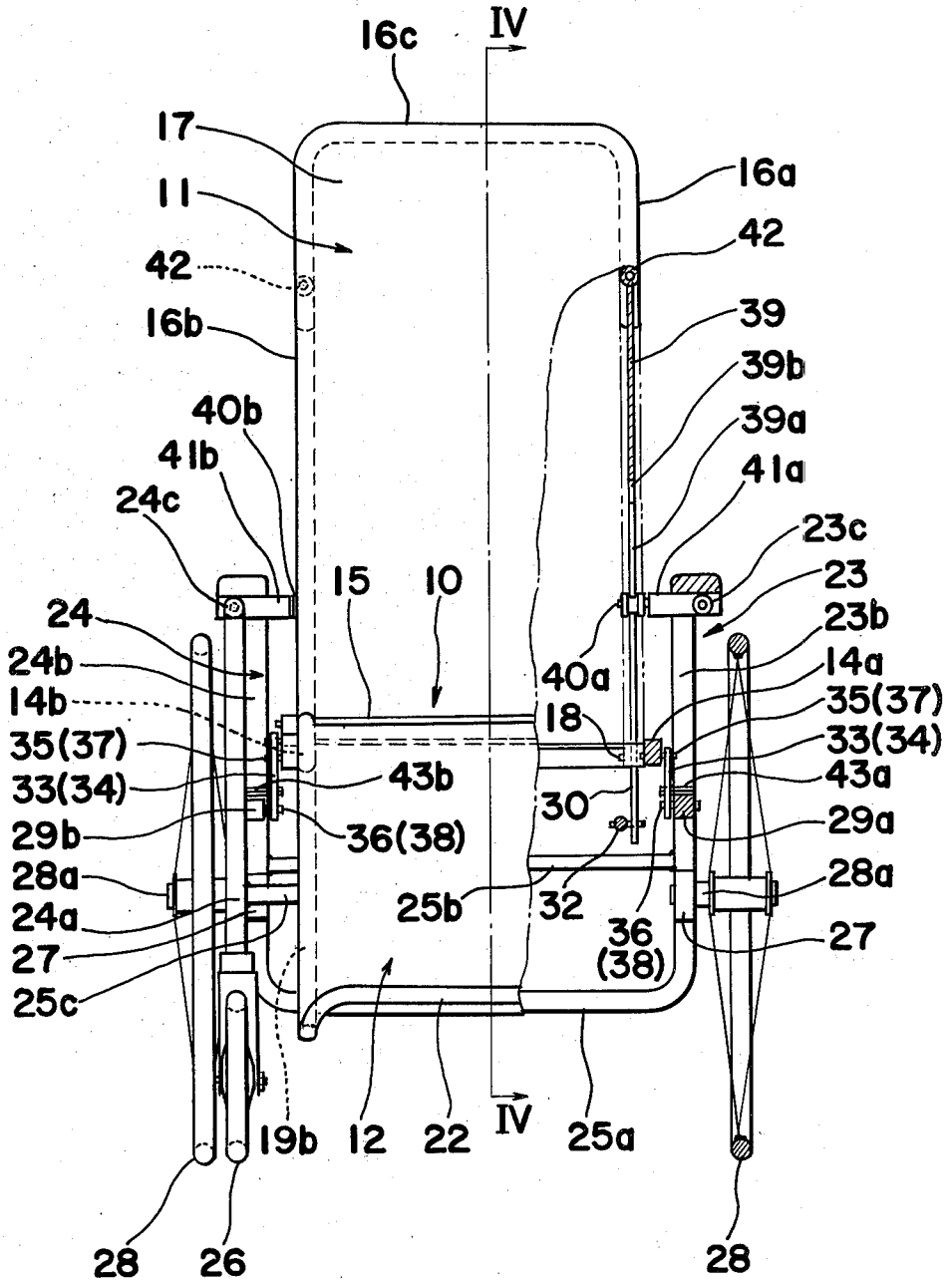
FIG. 6 is a front elevational view, with a portion broken away, of the combined chair and bed set in the chair mode.

Referring first to FIGS. 4 to 6, the combined chair and bed embodying the present invention comprises a seat assembly comprised of a seat 10 hinged at one side edge to a back rest 11 and at the opposite side edge to a leg support 12. So far illustrated, the seat 10 is comprised of a pair of spaced frame members 14*a* and 14*b* and a seat plate 15 of generally rectangular shape having its opposed side edge portions to which the frame members 14*a* and 14*b* are rigidly secured. The back rest 12 is comprised of a pair of parallel frame members 16*a* and 16*b* connected together at one end by means of a transverse frame member 16*c* to assume a shape substantially similar to the shape of a figure "U", and a back plate 17. The free ends of the respective parallel frame members 16*a* and 16*b* opposite to the transverse frame member 16*c* are pivotally connected to the frame members 14*a* and 14*b* by means of axially aligned and spaced hinge pins only one of which is shown by 18.

It is to be noted that the back rest 11 may be of one-piece construction with the frame members 16*a*, 16*b* and 16*c* and this can be achieved if a tubular metallic material is employed as a material therefor.

The leg support 12 is comprised of a pair of spaced frame members 19*a* and 19*b* connected pivotally at one end to the respective frame members 14*a* and 14*b* by means of axially aligned and spaced hinge pins, only one of which is shown by 20, a support plate 21 to which the frame members 19*a* and 19*b* are secured in spaced relation to each other, and a substantially U-shaped leg rest 22 having its opposed ends rigidly connected to the other ends of the frame members 19*a* and 19*b* and protruding in a direction at right angles to the plane of the support plate 21. Even this leg support 12 may be of one-piece construction with the frame members 19*a*, 19*b* and 22 and this can be achieved if a tubular metallic material is employed as a material therefor.

The seat assembly including the seat 10, back rest 11 and leg support 12 is supported by a frame assembly comprising a pair of generally U-shaped frame structures 23 and 24 each on one side of the seat assembly through a pair of link mechanisms of identical construction in a manner as will be described in details later, and a plurality of beam members of equal length which are identified by 25*a*, 25*b* and 25*c* and extend between the U-shaped frame structures 23 and 24 to keep the latter steadily and rigidly spaced apart from each other. As best shown in FIGS. 4 and 5, each of the U-shaped frame structures 23 and 24 includes a front leg 23*a* or 24*a* having one end rotatably mounted on a caster wheel 26, a rear leg 23*b* or 24*b* having one end portion carrying a bearing bracket 27, and an arm rest 23*c* or 24*c* extending generally horizontally and having its opposed ends rigidly connected to, or otherwise integrally formed with, the front and rear legs 23*a* or 24*a* and 23*b* or 24*b*. Steering wheels, generally identified by 28, are rotatably mounted on the respective bearing brackets 27 by means of axles 28*a* each having one end rigidly or rotatably connected to the corresponding bearing bracket 27 and the other end rotatably or rigidly connected to the corresponding steering wheel 28.

Each of the frame structures 23 and 24 has a reinforcement rod 29*a* or 29*b* having one end rigidly connected to the rear leg 23*b* or 24*b* and the other end rigidly connected to the front leg 23*a* or 24*a* and protruding a certain distance therefrom.

The link mechanisms simultaneously operable to set the combined chair and bed selectively in one of chair and bed modes are employed each on one side of the seat assembly and are of identical construction. Because of the link mechanisms of identical construction, only one of them will now be described in details.

The link mechanism positioned on one side of the seat assembly adjacent the U-shaped frame structure 23 comprises a rear arm 30 having one end rigidly secured to and protruding rearwardly from the frame member 16*a* of the back rest 11 at a position adjacent the hinge pin 18, a front arm 31 having one end rigidly connected to and protruding rearwardly from the frame member 19*a* of the leg support 12 at a position adjacent the hinge pin 20, and a connecting rod 32 having its opposed ends pivotally connected to the respective free ends of the rear and front arms 30 and 31. This link mechanism further comprises a pair of spaced links 33 and 34 extending in parallel relation to each other. The link 33 has one end pivotally connected to the frame member 14*a* at a position adjacent the hinge pin 18 by means of a hinge pin 35 and the other end pivotally connected to a substantially intermediate portion of the reinforcement rod 29*a* by means of a hinge pin 36 while the link 34 has one end pivotally connected to a substantially intermediate portion of the frame member 14*a* by means of a hinge pin 37 and the other end pivotally connected to the free end of the reinforcement rod 29*a* adjacent the front leg 23*a*.

Substantially elongated guide plates one for each link mechanism, only one of which is shown in FIGS. 4 to 6 by 39, are rigidly secured to the corresponding frame members 16*a* and 16*b* of the back rest 11 and extend in a direction parallel to the associated frame members 16*a* and 16*b*. These guide plates 39 are of identical construction and each has a slot 39*a* extending lengthwisely of the corresponding guide plate 39 and having one end formed with a detent recess 39*b*.

Rotatably and slidingly engaged in these guide slots 39*a* are rollers 40*a* and 40*b* rotatably mounted respectively on axle members 41*a* and 41*b* protruding from the respective joints, one between the rear leg 23*b* and the arm rest 23*c* of the frame structure 23 and the other between the rear leg 24*b* and the arm rest 24*c* of the frame structure 24, in a direction facing toward each other.

Rigidly connected to the frame members 16*a* and 16*b* of the back rest 11 and protruding rearwardly therefrom above the guide plates 39 are handles, generally identified by 42 accessible to the hands of an attendant or helper who may push the combined chair and bed when the latter is set in the chair mode as shown in FIGS. 4 and 5.

While the combined chair and bed according to the present invention is constructed such as described above, it is to be noted that the position of each of the rollers 40*a* and 40*b* and the length of each of the links 33 and 34 of each link mechanism are so selected and so designed that, when the back rest 11 in a generally upright position as shown in FIGS. 4 and 5 are tilted backwards to a laid-down position as shown in FIG. 5 with the movement of the back rest 11 being transmitted to the leg support 12 through the connecting rods 32, the back plate 17, the seat plate 15 and the support plate 21 are all held in flush with each other. In other words, when the combined chair and bed according to the present invention is set in the bed mode by tilting the back rest 11 from the upright position towards the laid-down position, thereby enabling the combined chair and bed to be utilized as a mobile bed.

Figure 2:
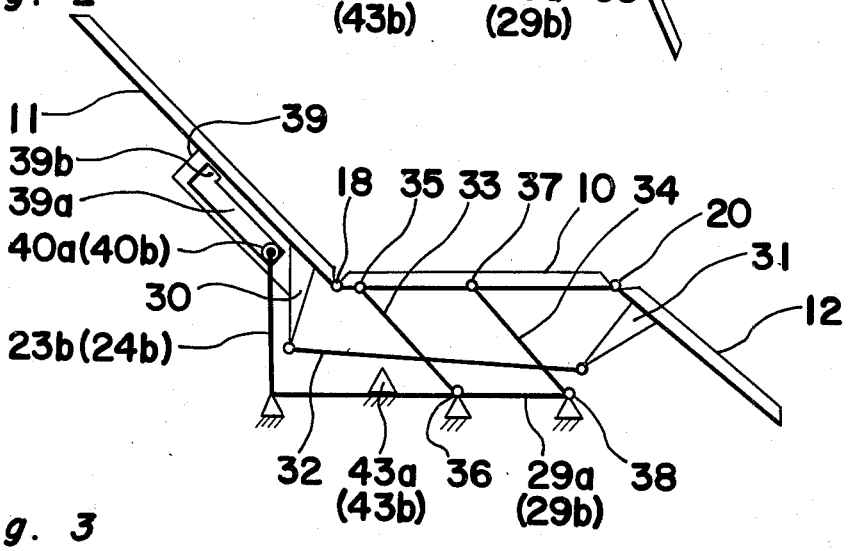
Figure 3:
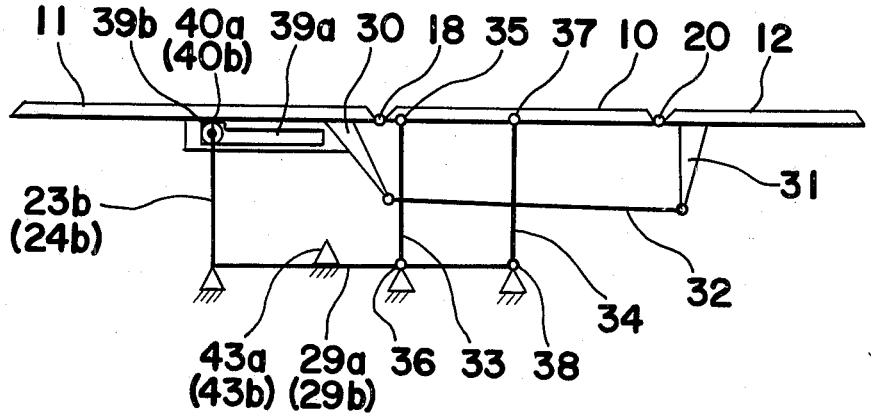

The operation of the combined chair and bed according to the present invention will now be described with particular reference to FIGS. 1 to 3.

Starting from the condition in which the combined chair and bed is set in the chair mode, that is, is utilizable as a chair as shown in FIGS. 1, 4 and 6, and when an external force is applied to the back rest 11 to tilt the latter backwards from the generally upright position towards the laid-down position, the movement of the back rest 11 in a counter-clockwise direction about the hinge pins 18 is transmitted through the connecting rod 32 to the leg support 12, thereby pivoting the leg support 12 in a counterclockwise direction about the hinge pins 20. Simultaneously therewith and, more specifically, simultaneously with the counterclockwise pivot of the back rest 11 about the hinge pins 18, the back rest 11 pivots about the rollers 40*a* and 40*b* with the hinge pins 18 consequently angularly upwardly shifted about the rollers 40*a* and 40*b*. On the other hand, during the angular upward movement of the axially aligned hinge pins 18 with respect to the axially aligned rollers 40*a* and 40*b*, the back rest 11 is displaced in a direction away from the seat 10 with the rollers 40*a* and 40*b* relatively displaced to the respective ends of the guide slots 39*a* in the associated guide plates 39 remote from the detent recesses 39*b* as best shown in FIG. 2 while the seat 10 is upwardly lifted with the links 33 and 34 pivoting clockwise about the respective hinge pins 36 and 38.

The continued application of the external force to the back rest 11 to tilt the latter towards the laid-down position results in that the back rest 11 once displaced in a direction away from the seat 10 is displaced in the opposite direction with the rollers 40*a* and 40*b* relatively moving within the respective guide slots 39*a* towards the detent recesses 39*b* while the links 33 and 34 continue their clockwise pivot about the hinge pins 36 and 38. When the rollers 40*a* and 40*b* are engaged in the detent recesses 39*b* as shown in FIGS. 3 and 5, the links 33 and 34 assume their generally upright positions with the back rest 11 held in flush with the seat 10. At the same time, since the movement of the back rest 11 is transmitted to the leg support 12 through the connecting rod 32, the leg support 12 is also held in flush with any one of the back rest 11 and seat 10, thereby enabling the combined chair and bed to be utilized as a mobile bed.

In order to switch the bed mode over to the chair mode, what is necessary is to lift the back rest 11 in the laid-down position upwardly and then to cause the back rest 11 to pivot clockwise about the axially aligned rollers 40*a* and 40*b*, allowing the links 33 and 34 to be automatically folded to assume such positions as shown in FIG. 1 by the effect of the weight of the back rest 11, seat 10 and leg support 12 until the links 33 are engaged to respective stoppers 43*a* and 43*b* rigidly mounted on the reinforcement members 29*a* and 29*b* as best shown in FIG. 6.

From the foregoing, it will readily be seen that, by suitably selecting the length of each of the links 33 and 34 in consideration of the height of the seat 10 when the combined chair and bed is set in the chair mode, the height of the bed constituted by the seat 10, back rest 11 and leg support 12 which are held in flush with each other when the combined chair and bed is set in the bed mode can be made equal to the height of a standard bed generally installed in a hospital.

In order to stabilize the bed constituted by the seat 10, back rest 11 and leg support 12 when the combined chair and bed is set in the bed mode, either one of the spans between the hinge pins 35 and 37 and between the hinge pins 36 and 38 is preferably larger than the other of the spans so that, when the combined chair and bed is set in the bed mode, the links 33 and 34 extend in slightly diverging relation to each other. In this case, when the combined chair and bed is in the chair mode, the seat 10 is backwardly inclined to provide a comfortable sitting to the patient.

Although the present invention has fully been described in connection with the preferred embodiment thereof with reference to the accompanying drawings, it is to be noted that various changes and modifications are apparent to those skilled in the art. By way of example, although the link mechanisms have been described as employed one on each side of the seat assembly, the number thereof may not be always limited to two such as described and shown, but it may be one. Where the only link mechanism is employed, it may be installed on either one side of the seat assembly or intermediate the width of the seat assembly. Simultaneously therewith or separately therewith, the number of transmission systems each comprised of the rear and front arms 30 and 31 and the connecting rod 32 may not be always limited to two such as shown and described, but may be one.

Moreover, depending upon the purpose for which the device of the present invention is utilized, one or both of the leg support 12 and the wheels 26 and 28 may be omitted. Where the wheels 26 and 28 are omitted, the combined chair and bed according to the present invention can be utilized as a stretcher when the device is set in the bed mode.

In addition, it is obvious to those skilled in the art to employ, instead of the stoppers 43*a* and 43*b*, an adjustable stopper which may comprises a rack member having one end pivotally connected to one of the links 33 and 34 and axially slidably extending through a bearing box rigidly secured to the reinforcement rod 29*a* or 29*b*, a toothed stopper selectively engageable with the teeth on the rack member and operatively housed within the bearing box, a manipulatable handle carried by the corresponding handle 42 for movement between disengaged and locked positions, and a transmission cable for transmitting the movement of the manipulatable handle for selectively engaging and disengaging the toothed stopper to and from the teeth on the rack member. By employing this adjustable stopper, the combined chair and bed according to the present invention can be utilized as a reclining chair in a manner substantially as shown in FIG. 2. In this case, the detent recess 39*b* may not be necessary.

Furthermore, because of the purpose for which the combined chair and bed according to the present invention is utilized, various obvious safety arrangement should be employed. By way of example, the guide plate 39 having the guide groove 39*a* defined therein is in practice constituted by one side of a bar member of generally U-shaped or rectangular cross section having a hollow in which the corresponding roller 40*a* or 40*b* is operatively housed. In addition, since the larger span between the wheels 26 and 28 is preferred when the combined chair and bed is in the bed mode than when it is in the chair mode to keep the bed in a balanced condition, each of the caster wheels 26 may be connected to the frame structure 23 or 24 through a generally L-shaped angle member having one end supporting the caster wheel 26 and the other end rotatably connected to the corresponding front leg 23*a* or 24*a* for the adjustment of the angle of the L-shaped angle member relative to the corresponding front leg 23*a* or 24*a*.

Accordingly, these and other changes and modifications which are obvious to, and fall within the preview of, those skilled in the art should be construed as included within the true scope of the present invention unless they depart therefrom.

What is claimed is:

1. A combined chair and bed which comprises:

a frame assembly comprising a pair of generally U-shaped frame structures of identical construction, a plurality of beam members extending between the frame structures to keep said frame structures in spaced relation to each other and a wheel assembly on which said frame structures are mounted for movement from place to place;

a seat assembly including a back rest supported in position for pivotal movement between a generally upright position and a laid-down position, and a seat hingedly connected at one side edge to the back rest, said back rest when in the upright position forming a certain angle relative to the seat to assume a generally L-shaped configuration in cooperation with the seat, said back rest when in the laid-down position being level with the seat, said seat assembly being positioned between said frame structures; and at least one link mechanism through which the seat assembly is mounted on the frame assembly, said link mechanism including means fixed relative to the frame assembly for providing a fulcrum about which the back rest pivots accompanied by the pivotal movement of the back rest relative to the seat, the hinge axis between the back rest and the seat moving angularly about the fulcrum during the pivotal movement of the back rest about said fulcrum, thereby shifting the seat relative to the frame assembly selectively upwardly and downwardly depending upon the direction of the pivotal movement of the back rest between the upright and laid-down positions, and link means pivotally supported for movement between generally inclined and upright positions, said link means, when said seat is upwardly shifted incident to the pivotal movement of the back rest from the upright position towards the laid-down position, being erected to assume the upright position to support the seat in flush with the back rest in the laid-down position.

2. A device as claimed in claim 1, wherein each of said U-shaped frame structures includes a reinforcement bar extending between the opposed end portions of said corresponding frame structure in a direction perpendicular to any one of the beam members and wherein said link means is constituted by a pair of spaced links each having one end pivotally connected to the seat and the other end pivotally connected to the reinforcement bar.

3. A device as claimed in claim 2, wherein said means fixed relative to the frame for providing the fulcrum comprises at least one guide slot defined in a substantially elongated plate member secured to the back of the back rest, and a roller element carried by the frame structure and engaged in said guide slot, the axis of rotation of said roller element providing said fulcrum.

4. A device as claimed in claim 1, wherein said seat assembly further includes a leg support having a foot rest, said leg support being hinged to the opposite side edge of the seat and extending therefrom in a direction opposite to the back rest, and further comprising a transmission mechanism for transmitting the pivotal movement of the back rest to the leg support, said leg support when the back rest is in the laid-down position being held in flush with any one of the back rest and the seat.

5. A device as claimed in claim 1, wherein said seat assembly further includes a leg support having a foot rest, said leg support being hinged to the opposite side edge of the seat and extending therefrom in a direction opposite to the back rest, and further comprising a transmission mechanism for transmitting the pivotal movement of the back rest to the leg support, said leg support when the back rest is in the laid-down position being held in flush with any one of the back rest and the seat.

6. A device as claimed in claim 2, wherein said seat assembly further includes a leg support having a foot rest, said leg support being hinged to the opposite side edge of the seat and extending therefrom in a direction opposite to the back rest, and further comprising a transmission mechanism for transmitting the pivotal movement of the back rest to the leg support, said leg support when the back rest is in the laid-down position being held in flush with any one of the back rest and the seat.

7. A device as claimed in claim 3, wherein said seat assembly further includes a leg support having a foot rest, said leg support being hinged to the opposite side edge of the seat and extending therefrom in a direction opposite to the back rest, and further comprising a transmission mechanism for transmittng the pivotal movement of the back rest to the leg support, said leg support when the back rest is in the laid-down position being held in flush with any one of the back rest and the seat.

* * * * *